US005323551A

United States Patent [19]

Lovison et al.

[11] Patent Number: 5,323,551

[45] Date of Patent: Jun. 28, 1994

[54] PICTURE FRAME

[76] Inventors: Douglas I. Lovison, 3468 Sitio Baya, Carlsbad, Calif. 92009; Lawrence J. Longobardi, 290 Rancho Santa Fe Rd., Encinitas, Calif. 92024

[21] Appl. No.: 884,783

[22] Filed: May 18, 1992

[51] Int. Cl.[5] ..... G09F 1/12

[52] U.S. Cl. ..... 40/152.1; 40/156

[58] Field of Search ..... 40/152, 152.1, 154, 40/156, 158.1, 661; 206/456, 486, 488, 489; 220/352, 353

[56] References Cited

U.S. PATENT DOCUMENTS

| | | | |
|---|---|---|---|
| 859,199 | 7/1907 | Chinnery . | |
| 1,694,847 | 12/1928 | Donaldson . | |
| 1,802,999 | 4/1931 | Budd | 40/152 |
| 1,867,314 | 7/1932 | Gurwick . | |
| 2,235,791 | 3/1941 | Wohlers . | |
| 2,647,834 | 8/1953 | Rabkin et al. | 40/154 X |
| 3,046,853 | 7/1962 | Legendre | 220/353 X |
| 3,408,759 | 11/1968 | Rotheraine et al. | 40/152 |
| 3,789,529 | 2/1974 | Thom | 40/158.1 |
| 3,805,049 | 4/1974 | Frank et al. . | |
| 3,836,419 | 9/1974 | Hamberger | 40/152.1 X |
| 3,900,641 | 8/1975 | Woodman et al. . | |
| 3,931,425 | 1/1976 | Kuroda . | |
| 3,956,838 | 5/1976 | Gerrish | 40/154 |
| 4,067,129 | 1/1978 | Abramson et al. | 40/563 |
| 4,104,867 | 8/1978 | Worsham | 220/352 X |
| 4,127,689 | 11/1978 | Holt . | |
| 4,500,374 | 2/1985 | Nakazima . | |
| 4,721,635 | 1/1988 | Helinski . | |
| 4,791,010 | 12/1988 | Hanley et al. . | |
| 4,848,014 | 7/1989 | Yesbick | 40/152 X |
| 4,933,218 | 6/1990 | Longobardi . | |
| 4,952,462 | 8/1990 | Bright . | |
| 5,010,672 | 4/1991 | Coleman | 40/615 |
| 5,106,126 | 4/1992 | Longobardi et al. . | |
| 5,133,450 | 7/1992 | Rademacher | 40/156 X |

FOREIGN PATENT DOCUMENTS

| | | | |
|---|---|---|---|
| 88306084 | 7/1988 | European Pat. Off. . | |
| 3247964 | 7/1984 | Fed. Rep. of Germany . | |
| 2234434 | 2/1991 | United Kingdom | 40/158.1 |

*Primary Examiner*—Kenneth J. Dorner
*Assistant Examiner*—J. Bonifanti
*Attorney, Agent, or Firm*—Nydegger & Associates

[57] ABSTRACT

A picture frame is provided which has a frame portion and a frictionally retained insert. The frame portion is a single piece of plastic including a recess defined by a raised wall. The raised wall includes a plurality of recess-facing constricting tabs which as a result of their sloped faces increase frictional pressure on the insert as the insert is placed deeper into the recess. The insert is a flat member sized to snugly fit into the recess and to prevent a photograph from unintentionally exiting the recess. Included along the peripheral edge of the insert are a plurality of slots to cooperatively engage the constricting tabs of the frame. The front surface of the frame has an applique placed thereon and is shaped such that a portion of the front surface extends through the applique.

16 Claims, 2 Drawing Sheets

34b
36
2
3
2
3
28
24
30
10
20
12
18
22
16
26
14

10
30
22
28a
32
24
28b
12
20
40
44
42

10
22
28a
24
28b
12
20
40
44
42

PICTURE FRAME

TECHNICAL FIELD

The present invention pertains to picture frames and their method of manufacture. More specifically, the present invention relates to free-standing picture frames. The present invention is particularly, although not exclusively, useful for displaying photographs.

BACKGROUND OF THE INVENTION

People have been displaying paintings and other pictures for centuries. Typically the paintings were, and still are, placed in a frame and hung on a wall or set on a desk or a table. The frames used in the past range from ornate gilded wood frames to simple metal frames. Photographic pictures have been displayed in both wall-hung frames and in free-standing frames. The free-standing frames used today typically consist of a wood or metal frame having a piece of glass placed therein. The photograph to be displayed is placed in contact with the glass such that the picture side of the photograph is facing the glass. To keep the photograph in the frame, some type of retaining system is normally included with the frame. The retaining system is often a piece of cardboard placed in back of the photograph and held in place by a series of bendable metal clips on the periphery of the frame. After the photograph and the cardboard are placed into the frame, the clips are bent to extend inward from the frame and across the cardboard to form a barrier thereby retaining both the cardboard and the photograph in the frame. In the past, most free-standing photographic frames were maintained in a substantially upright configuration by using a brace connected to the back side of the cardboard retaining member. These braces were often simply triangular tabs of cardboard which could swing out from the cardboard on vertical hinges.

More recently, advances in plastics and plastic production techniques have produced a new industry making plastic frames. Some of the frames produced merely replaced the wood or metal portion of the frames discussed above. On the other hand, others have begun producing single piece, all plastic frames for photographs. The all plastic frames are made by taking a thin sheet of plastic and folding it twice. The resulting frame has a main portion into which the photograph is placed and a base portion which supports the main portion while it supports the main portion. The main portion is generally an inverted U-shaped piece of the plastic having a 180° bend at its top. The photograph is placed from the side into the space between the front and the back section of the plastic. The base is an extension of the front section which is folded under the main portion of the frame producing an angle between the base and the back portion between 90° and about 60°. These types of frames have the drawback that the photographs are not firmly held in the internal space which results in the pictures tending to slide out of the frames.

In light of the above, it is an object of the present invention to provide a frame for displaying a photograph. Further, it is an object of the present invention to provide a picture frame which firmly retains the photograph. Another object of the present invention is to provide a picture frame that is substantially a single piece of plastic which can be injection molded. Yet another object of the present invention is to provide a picture frame having a front surface suitable for accepting the placement of appliques. And yet another object of the present invention is to provide a picture frame which is aesthetically pleasing. Further, an additional object of the present invention is to provide a picture frame which is relatively easy to manufacture and is comparatively economical.

SUMMARY OF THE INVENTION

A picture frame is provided which includes a frame portion and an insert. The frame has a base portion supporting an upright portion which includes a recess sized to contain a photograph. The recess is formed by a raised wall structure extending outwardly from the back side of the upright portion. The raised wall can include a plurality of constricting tabs on the inside edge of the wall to apply added pressure on the insert when the insert is placed in the recess. The constricting tabs are sloped to increase pressure on the insert as the insert is placed deeper into the recess.

The insert of the present invention is sized to snugly fit into the recess. Additionally, the insert includes slots on its peripheral edge to receive the constricting tabs. Having slots in the insert increases the surface area of the insert in contact with the tab by allowing the insert to contact not only the corners of the tabs but also the entire sloped surface and sides of the tabs. The increased contact area increases the frictional force retaining the insert in the recess. The insert further includes a hinged flap which facilitates removal of the insert from the recess by allowing a person to grip and pull the insert.

The base portion of the frame is attached to an edge of the upright portion such that the angle formed between the base and the upright portion is less than ninety degrees. The front side of upright portion of the frame is substantially flat and can accept an applique that will effectively border the front side. The applique includes an opening through which the photograph is viewed and through which a raised portion of the upright portion can extend.

The frame is normally a single piece of clear styrene plastic which was injection molded, polished and bent to produce the free-standing picture frame described above. The desired applique is then bonded to the front side of the upright portion.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
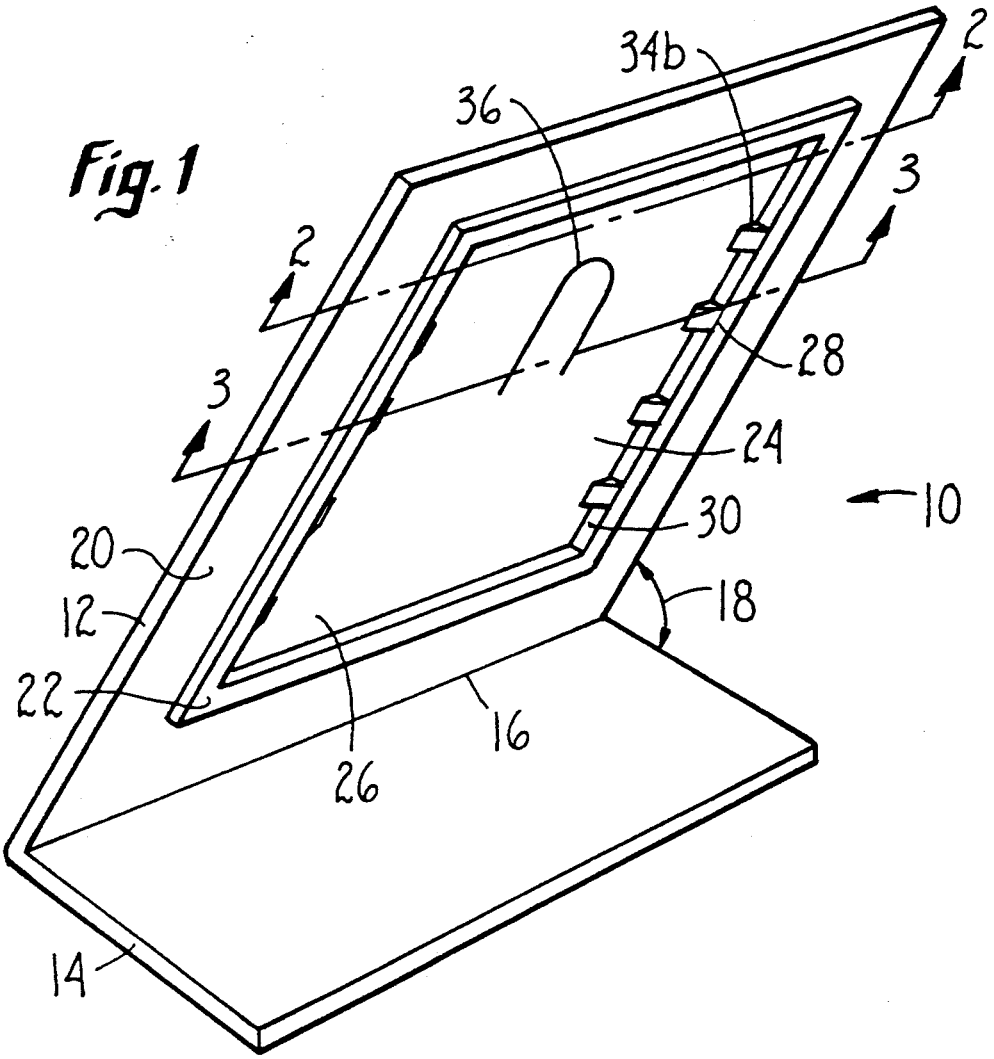
FIG. 1 is a perspective view of the backside of the picture frame of the present invention.

Referring initially to FIG. 1, the picture frame of the present invention is shown and generally designated 10. The picture frame includes a frame or upright portion 12 and a base 14. Base 14 is attached to the lower edge 16 of the upright portion 12 of the picture frame 10. The connection between base 14 and upright portion 12 forms an angle 18 which is typically less than ninety degrees and is preferably between sixty and eighty degrees. Angle 18 must be such that the gravitational axis of the center of gravity of the upright portion intersects the base 14. This ensures that the picture frame 10 is stable and will remain upright.

Figure 2:
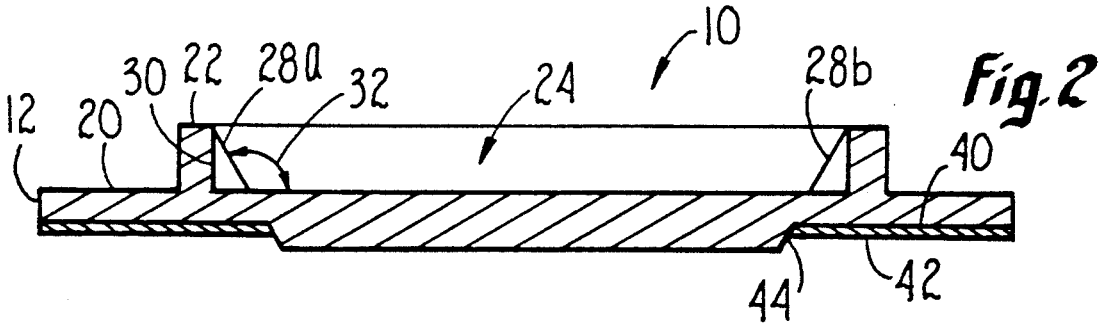
FIG. 2 is a cross-sectional view of the picture frame of the present invention along line 2—2 in FIG. 1.
Figure 3:
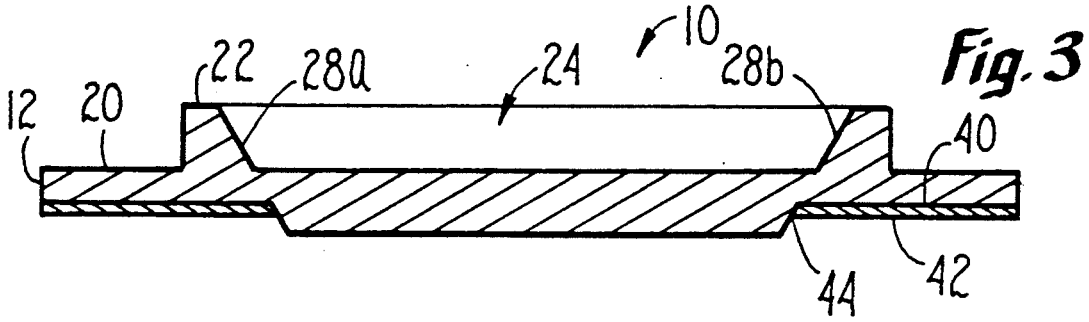
FIG. 3 is a cross-sectional view of the picture frame of the present invention along line 3—3 in FIG. 2.

The backside 20 of the upright portion 12 of the picture frame 10 is formed to include a raised wall 22 which defines a recess 24 to receive a photograph and an insert 26. Wall 22 preferably includes a plurality of constricting tabs 28 which are located on the inside edge 30 of the wall 22. Referring now to FIGS. 2 and 3, the constricting tabs 28*a* and 28*b* are sloped to provide increasing constriction pressure on the insert as it is placed deeper into the recess 24. The sloped portion of tabs 28 are preferably flat and relatively narrow. It will be appreciated by those skilled in the art that tabs 28 could also have rounded sloped surfaces without departing from the scope of the present invention. The angle 32 between the sloped portion of a tab 28 and the bottom of the recess is typically between ninety-five (95) and one hundred forty (140) degrees. Preferably angle 32 is in the range of one hundred (100) and one hundred ten (110) degrees.

While the recess 24 could retain the insert 26 without the tabs 28, it is preferred that at least four tabs 28 be used. Optimally, the constricting tabs 28 are positioned in pairs on opposite sides of the recess. The upright portion 12 and base 14 are formed of a relatively rigid material such as hard plastic. Preferably, the material is a clear plastic such as styrene.

Figure 4A:
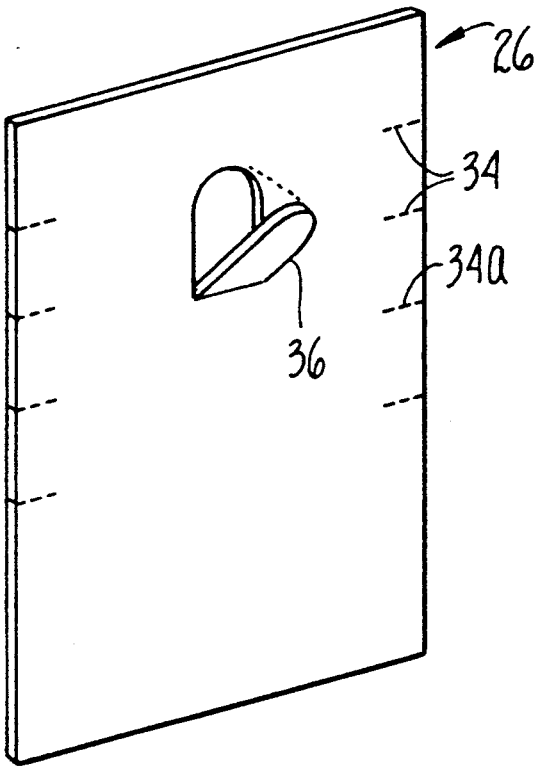
FIG. 4A is a perspective view of the insert included in the picture frame of the present invention where the insert includes single-cut slots.
Figure 4B:
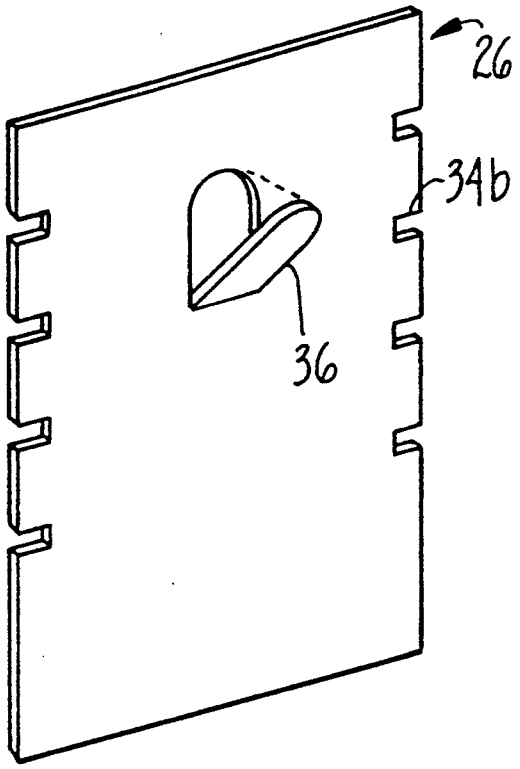
FIG. 4B is a perspective view of the insert included in the picture frame of the present invention where the insert includes cut-out slots.

Referring now to FIG. 4 the insert of the present invention is shown and generally designated 26. Insert 26 is preferably formed of a semi-rigid material such as cardboard, soft plastic or hard rubber. As can be appreciated, other materials having suitable characteristics can be used without departing from the scope of the invention. While insert 26 preferably includes a plurality of slots 34, it is within the scope of the invention to use insert 26 without slots 34. Slots 34 can be either a single-cut slot 34*a* as shown in FIG. 4A, or a cut-out slot 34*b* as shown in FIG. 4B. While either slot will work, the cut-out slot 34*b* will allow greater gripping of the tab 28 with minimal deformation of the portion of insert 26 around tab 28. Cut-out slots allow the insert to contact a tab 28 on not only the corners of the tab, but also the sloped surface and the sides of the tab 28. If slots 34 are included in insert 26, there is preferably one slot 34 for each tab 28 at locations such that the tabs 28 will cooperatively engage the slots 34 as insert 26 enters the recess. Also included on insert 26 is a hinged flap 36 which is shown in FIG. 4 as a piece cut out of the insert 26. It is to be appreciated that the flap 36 could just as well have been a separate piece bonded or attached to the insert. Flap 36 is swingable in a direction away from the recess 24 to allow a person to grip the tab to remove the insert 26 from recess 24. When not needed, flap 36 can be pushed into opening 38.

Referring now to FIGS. 2 and 3 again, the front side of the upright portion 12 is substantially flat and is suitable for accepting an applique 42. To allow viewing of a photograph, applique 42 includes an opening 44. Applique 42 is used to crop unwanted portions of the photograph and to improve the aesthetic characteristics of the picture fame. In order to optimize the viewablity of the photograph, a raised portion 46 extends out from the front side 40 of the upright portion 12 and extends through the opening 44 of the applique 42.

Figure 5:
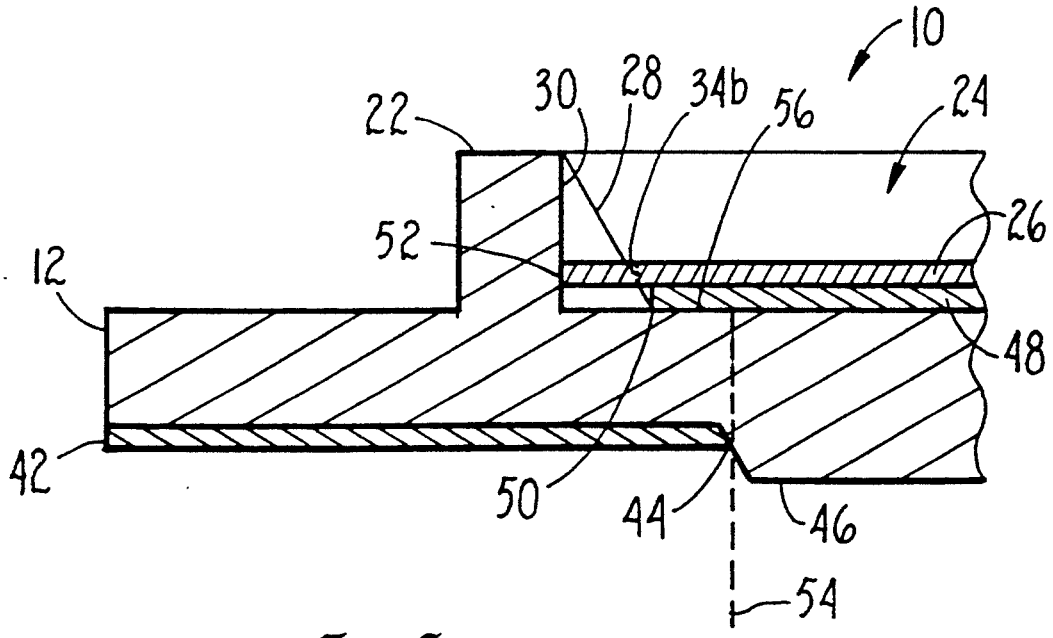
FIG. 5 is a partial cross-section of the picture frame of the present invention showing a photograph retained in the recess of the frame.

The relative dimensions as well as the cooperation between the elements of the present invention can best be seen in FIG. 5 in which a photograph 48 is shown in the picture frame 10. Photograph 48 is located in recess 24 and is sandwiched between the upright portion 12 and the insert 26. The outer edge 50 of the photograph 48 extends only up to the base of tab 34 whereas the outer edge 52 of the insert 26 extends to the inside edge 30 of the raised wall 22. Cut-out slot 34*b* extends into insert 26 only sufficiently to allow firm engagement between the slot 34*b* and the sloped face of tab 34. Opening 44 of applique 42 is such that interaction with the sight line 54 past the edge of the opening 44 crops a portion 56 of photograph 48.

Upright portion 12 and base 14 are preferably manufactured from a single piece of injection molded styrene plastic. The upright portion 12 and the base 14 can be injection molded as a substantially flat piece or, to maximize mold efficiency, as a single piece including a ninety degree bend. After injection molding, the piece is bent along edge 16 as shown in FIG. 1 to the requisite angle 18. The surfaces of the picture frame can be polished to ensure smooth clear plastic. To crop the photograph and to obscure from view tabs 28, applique 42 is bonded to the front side 40 of the upright portion 12. To complete the device of the present invention, an insert 26 is constructed out of a flat section of material by making a peripheral cut such that a tight fit is ensured between the insert and the recess. Finally, slots 34 are cut into the insert 26 to allow cooperative engagement between the slots 34 and constricting tabs 28.

While the particular picture frame as herein shown and disclosed in detail is fully capable of obtaining the objects and providing the advantages herein before stated, it is to be understood that it is are merely illustrative of the presently preferred embodiments of the invention and that no limitations are intended to the details of construction or design herein shown other than as described in the appended claims.

We claim:

1. A device for displaying a photograph comprising:

a substantially flat upright portion having a front and a back side, said back side formed with a recess for receiving the photograph, said recess being defined by a rectangular wall structure extending outwardly away from said back side of said upright portion, said wall structure including a plurality of tabs;

an insert retaining the photograph in said recess by means of friction between at least one edge of said insert and said recess, said friction resulting from constricting pressure being provided by said tabs at points on said edge of said insert when said insert is within said recess; and a base connected to said upright portion to maintain said upright portion in a substantially upright configuration.

2. The device as recited in claim 1 wherein the photograph is positioned between said upright portion and said insert.

3. The device as recited in claim 2 wherein said upright portion includes an applique bonded to said front side of said upright portion.

4. The device as recited in claim 3 wherein said front side of said upright portion forms a raised portion extending through an opening in said applique.

5. The device as recited in claim 4 wherein said base is connected to said upright portion at an edge of said frame at an angle of less than ninety degrees.

6. The device as recited in claim 5 wherein said upright portion and said base comprise substantially transparent plastic.

7. The device as recite in claim 6 wherein said plastic is styrene plastic.

8. The device as recited in claim 1 wherein said constricting tabs are sloped to increase said pressure as said insert moves further into said recess.

9. A device for displaying a photograph comprising:

a substantially L-shaped frame having a base portion and an upright portion, said upright portion forming a recess defined by a wall member sized to receive the photograph, said wall member extending outwardly from said upright portion, said frame including an applique bonded to said upright portion, said frame forming a raised portion extending through an opening in said applique; and a retaining means bordering on said recess for retaining the photograph in said recess by means of friction resulting from constriction of an insert by said retaining means, said retaining means applying constricting pressure to said insert at a plurality of points when the photograph is located between said upright portion and said insert, said pressure increasing as said insert moves further into said recess.

10. The device as recited in claim 9 wherein said frame comprises substantially transparent styrene plastic.

11. A device for displaying a photograph, comprising:

a substantially flat upright portion having a front and a back side, said back side formed with a recess for receiving the photograph;

an insert frictionally retaining the photograph in said recess;

a base connected to said upright portion to maintain said upright portion in a substantially upright configuration;

a rectangular wall structure extending outwardly away from said back side of said upright portion, to define said recess;

a plurality of constricting tabs on an inside edge of said recess; and a plurality of slots at points on said insert aligned with said constricting tabs, to allow additional surface area of said insert to contact said tabs;

wherein, the photograph is positioned between said upright portion and said insert, said insert is sized to fit tightly in said recess to produce a frictional force sufficient to retain said insert in said recess, and said tabs provide pressure at said points on said insert when said insert is in said recess.

12. The device as recited in claim 11 wherein said insert has a hinged flap to facilitate removal of said insert from said recess.

13. A device for displaying a photograph comprising:

a substantially flat upright portion having a front and a back side, said back side formed with a recess for receiving the photograph, said recess being defined by a rectangular wall structure extending outwardly away from said back side of said upright portion;

an insert retaining photograph in the said recess by means of friction between at least one edge of said insert and said recess, said friction being the result of constriction of said insert by said recess, said photograph being positioned between said upright portion and said insert;

a base connected to said upright portion to maintain said upright portion in a substantially upright configuration;

an applique bonded to said front side of said upright portion wherein said front side of said upright portion forms a raised portion extending through an opening in said applique.

14. The device as recited in claim 13 wherein said base is connected to said upright portion at an edge of said frame at an angle of less than ninety degrees.

15. The device as recited in claim 13 wherein said upright portion and said base comprise substantially transparent plastic.

16. The device as recite in claim 14 wherein said plastic is styrene plastic.

* * * * *